US006070528A

United States Patent [19]

Fleischmann et al.

[11] Patent Number: 6,070,528

[45] Date of Patent: Jun. 6, 2000

[54] PROCESS AND DEVICE FOR GRAVURE PRINTING WITH AN ERASABLE GRAVURE FORM

[75] Inventors: Hans Fleischmann; Godber Petersen; Rainer Stamme, all of Augsburg, Germany

[73] Assignee: Man Roland Druckmaschinen AG, Offenbach am Main, Germany

[21] Appl. No.: 08/878,926

[22] Filed: Jun. 19, 1997

[30] Foreign Application Priority Data

Jun. 19, 1996 [DE] Germany ..... 196 24 441

[51] Int. Cl.[7] ..... B41M 1/10; B41C 1/05

[52] U.S. Cl. ..... 101/170; 101/491; 101/478

[58] Field of Search ..... 101/170, 150, 101/153, 401.1, 491, 456, 478

[56] References Cited

U.S. PATENT DOCUMENTS

| | | | |
|---|---|---|---|
| 1,604,082 | 10/1926 | Smothers . | |
| 3,661,575 | 5/1972 | Ketley et al. . | |
| 4,729,310 | 3/1988 | Love, III . | |
| 5,154,121 | 10/1992 | Schneider | 101/170 |
| 5,658,964 | 8/1997 | Amon et al. | 522/31 |
| 5,718,171 | 2/1998 | Tittgemeyer . | |

FOREIGN PATENT DOCUMENTS

| | | | |
|---|---|---|---|
| 2096170 | 11/1993 | Canada | 101/170 |
| 9310798 | of 0000 | European Pat. Off. . | |
| 640 477 | 3/1995 | European Pat. Off. . | |
| 663 288 | 7/1995 | European Pat. Off. . | |
| 19503951 | of 0000 | Germany . | |
| 19 27 323 | 12/1969 | Germany . | |
| 2 100 031 | 7/1971 | Germany . | |
| 27 48 062 | 5/1978 | Germany . | |
| 37 39 829 | 6/1988 | Germany . | |
| 3837941 | 5/1990 | Germany . | |
| 4307766 | 9/1994 | Germany . | |
| 43 41 567 | 6/1995 | Germany . | |

OTHER PUBLICATIONS

English language abstract of Japan 61 284441 dated Dec. 15, 1986.

*Primary Examiner*—Kimberly Asher
*Attorney, Agent, or Firm*—Cohen, Pontani, Lieberman & Pavane

[57] ABSTRACT

Starting from a blank gravure form, a filling step and a subsequent imaging step are carried out to produce a printing form. In the filling step, depressions are evenly filled with a UV printing ink by an application device, and the UV printing ink is then solidified by a UV drier. In the imaging step, solidified UV printing ink is removed from the depressions in accordance with the image by thermal ablation. The gravure form screened in accordance with the image is then inked with UV printing ink by an inking system. For reuse, the gravure form undergoes an erasure step that uses UV printing ink.

13 Claims, 3 Drawing Sheets

PROCESS AND DEVICE FOR GRAVURE PRINTING WITH AN ERASABLE GRAVURE FORM

BACKGROUND OF THE INVENTION

1. Field of the Invention

The invention relates to a process and a device for gravure printing with an erasable and reusable gravure form, starting from a blank gravure form with a basic screen that is designed for at least the maximum quantity of ink to be transferred.

2. Description of the Prior Art

Gravure printing is a printing process in which the printing elements are more deeply inlaid than the printing form surface. After the printing form has been completely inked, its surface is cleared of printing ink, so that ink only remains in the depressions. Gravure printing forms include, for example, copper-plated steel cylinders, hollow cylinders slipped onto clamping cores and, in some cases, copper sheets clamped onto cylinders.

The manner of inking and clearing the ink from the form surface by blades permits no pure surface printing. The entire drawing must be resolved into lines, points or screen elements. Because of their different depths and sizes, individual printing elements hold more or less ink. The printed image therefore has different ink strengths at different points.

Various methods are used today to produce gravure forms. For example, among the variabledepth processes, there is the etching method, which consists of the slow diffusion of concentrated iron chloride solutions through a pigment gelatin layer. The pigment copy on the copper printing form consists of a solidified gelatin relief, which corresponds to the tonal gradations of the diapositive. The engraving process is distinguished by the line-by-line scanning of image and text with photo cells and the simultaneous engraving of the printing form with engraving heads. Special mention should be made of the production off depressions in the copper layer of the printing form by means of a high-energy electron beam, which is directed onto the blank form in a vacuum and removes material from the form in accordance with the image. Printing forms engraved in this manner can be provided with screens of variable depth and area.

It is also possible to create depressions by means of a high-energy laser beam. In this case, measures must be taken to ensure the input of the laser energy into the substrate, because without special pretreatment, copper, in particular, reflects laser beams to a great extent.

Furthermore, German reference DE OS 27 48 062 discloses a process for producing an engraved printing form as follows: First, a blank gravure form is prepared, in that its smooth surface is provided evenly with depressions of the same depth and size. Then, the engraved surface is covered with a light-sensitive mass so that all depressions are filled. After this, the blank form is exposed photographically to the desired image, so that the exposed areas polymerize. The unexposed portions can be washed out and image differentiation is thus achieved.

In general, in all gravure printing processes, the image locations of the printing form lie deeper than non-image locations. Particularly in blade gravure printing, the screen network is formed by stems of equal height, which border the image locations and form a resting surface for the blades. A separate set of printing form cylinders is needed for each print job (one printing form cylinder per ink color, with a corresponding number of print sides). These cylinders have the particular circumference required for the printing format in question. When a gravure printing machine or a rotary printing machine is readied for use, the appropriate printing form cylinders must be exchanged. These cylinders, which have a width of 200 cm, for example, currently weigh approximately 800 kg. Because the processes described above must be carried out outside of the printing machine, high mechanical expense is involved. In addition, each of these production methods includes steps, such as galvanization, coating, exposure and development, which make it impossible to reuse the same printing form without extensive—and, in part, chemical—treatment. Moreover, after etching or engraving in accordance with the image takes place, i.e., after material is removed, chrome-plating is usually performed to increase the serviceable life.

As a rule, if a printing form is to be stored for repeat jobs, space must be prepared for the entire cylinder. Printing form production is complicated and thus expensive, particularly when galvanic steps are required. Moreover, the toxic slurries created during production are an ecological problem.

In contrast, German reference DE 38 37 941 C2 discloses a process for producing a gravure form that allows imaging to be carried out directly in the printing machine. This process also permits the image on the gravure form to be erased in the printing machine and the form to be prepared there for a new image. Moreover, a blank gravure form is produced with a basic screen designed for at least the maximum quantity of ink to be transferred. In the printing machine, a thermoplastic substance is introduced into the depressions, from a nozzle of the pixel transfer unit or by means of image-correlated impressing, in a quantity inversely proportional to the image data for the purpose of reducing the scoop volume of the depressions. In other words, this method, in contrast to the others, calls for material to be applied to a blank gravure form in accordance with the image. After the printing job, it is possible to liquify the thermoplastic substance using a heat source in the printing machine, and then to remove the liquified substance from the printing form cylinder by a wiping and/or blowing or suctioning device.

However, applying material in accordance with the image poses problems with respect to the accuracy of the image position. Without further measures, it is not possible to completely introduce material stored on the stems into the depressions. Nonetheless, complete introduction is necessary if the transferred material as a whole is to help reduce the scoop volume of the depressions as desired.

In an earlier German Patent Application P 195 03 951, it has already been proposed to evenly fill the depressions in the basic screen of the blank gravure form with a liquefiable substance by accordance with the image by means of a pixel transfer device. Next, the screened gravure form is inked in accordance with the image by means of an inking system. Then, printing takes place using the gravure process, after which the blank gravure form can be regenerated and the depressions can again be filled evenly.

The liquefiable substance for filling the basic screen can, for example, be a thermoplastic material. The substances that can be used include thermoplastics (plastomers), e.g., polyolefins, vinyl polymers, polyamides, polyesters, polyacetates, polycarbonattes and, in some cases, polyurethanes and ionomers, as well as hot melt (wax), lacquer or an interconnectable polymer melt or solution.

A laser, preferably an NdYAG or an NDYLF laser, is used to burn the filled gravure form free in accordance with the image.

Inking with aqueous printing ink is carried out by means of a chamber blade, and a print stock is printed, preferably by indirect gravure printing.

After the required printing sequence, the gravure form is cleaned of ink residues by a regeneration device, preferably an ultrasonic cleaning unit, and the liquefiable substance is removed from the depressions of the basic screen. This allows the cycle of filling, ablation in accordance with the image, inking, printing and regeneration to begin anew.

Image erasure (regeneration) is also possible by completely cleaning the basic form with a pressurized water jet from a high-pressure cleaner. To this end, an arrangement such as that disclosed in European reference EP 9 310 798 is used. Such an arrangement comprises a double-walled chamber that is open toward the gravure form, but closed relative to the surrounding environment by seals running across the form. The inner cell contains nozzles, through which water is sprayed at high pressure onto the surface of the gravure form. There is suctioning out of the outer chamber area, which is surrounded by a mantle, so that fluid is removed, particularly from the area already cleaned, and the gravure form is clean and dry after treatment.

The high-pressure cleaner can work on at least two different levels. One level essentially uses a low liquid pressure and/or temperature to remove the remaining ink, while the other levels use a higher liquid pressure and/or temperature to partially or completely remove the filling material.

The above statements all relate to an implementation of the described measures inside of a gravure printing machine. It is understood, however, that the described measures can be implemented outside of a printing machine as well.

In such rotary printing processes, as a rule, an ink that contains a solvent (even water-based printing inks contain certain amounts of solvent) is transferred onto the printing stock. The solvent must be then extracted from the printed stock and from the ink layer on or partly' penetrating the stock. This is done in a drying section of the printing machine. The large amount of space required for a drier and the high expenditure of energy for drying are disadvantageous. In addition, the emitted solvents pollute the environment. Furthermore, when the ink film of a water-based printing ink is dried, amines used for saponification and ammonia also escape into the ambient air. These released compounds are not only malodorous, but also hazardous to health.

Furthermore, until now it has always been necessary to use at least three different process media to regenerate the basic form, especially when high-pressure cleaners are used. These media are the erasure fluid (water), the printing ink (usually a solvent-containing ink) and the filler (liquefiable substance). A certain risk of the process media becoming-mixed during production therefore exists.

A further development of printing inks focuses on inks with UV solidifiable binding agent systems, which make use of the generally known principle of UV solidification.

For example, German reference DE 43 07 766 C1 describes a process for producing a UV solidified flexographic printing ink and its use in flexographic printing machines.

The UV printing inks contain inking substances and additives, along with photo initiators, which, when subjected to UV radiation, trigger polymerization of the binding agent components also contained in the ink. As described in DE 43 07 776 C1, UV systems of this type can polymerize by a radical or by a cationic mechanism. UV inks contain no solvents or water. Technical, health-related and environmental disadvantages and problem, such as are caused by solvents or water in printing inks, do not arise in connection with UV printing inks.

SUMMARY OF THE INVENTION

Starting from this, it is an object of the present invention to provide a process and a device for gravure printing that, first of all, make it possible to avoid the use of evaporating solvents and hazardous compounds when using an erasable and reusable gravure form and, secondly, simplify the generic process concept.

According to the invention, the depressions in the basic screen of the blank gravure form are filled by a UV printing ink in a filling step and the ink in the depressions is solidified. Then, in an imaging step, solidified UV printing ink is removed from the depressions by thermal ablation. Next, the imaged screen is again inked with liquid UV printing ink. After the printing process, an erasure step using UV printing ink is carried out to allow reuse of the gravure form. Thus, only one process medium is used, which performs all functions, i.e., those of erasure fluid, printing ink and filler. Furthermore, evaporating solvents and hazardous compounds are no longer present, the risk of process media becoming mixed is eliminated and, at the same time, increased process reliability is achieved.

The direct result of this is that the entire process is simplified and that fewer subsystems are therefore required in a device to implement the process. Thus, in the present invention, the erasing, filling and chamber blade systems needed in the generic process are implemented by an aggregate.

Further particular advantages result from the use of liquid UV printing inks in the process according to the invention. For example, because the ink has the property of not drying, its use is especially advantageous for indirect gravure printing and for automatic processes occurring over long periods of time.

Furthermore, the high ink strength is advantageous for laser performance requirements. Finally, and not least importantly, the driers can be relatively small in size, so that the device can be compactly designed.

In another embodiment of the inventive method, the filling is completely removed from the depressions to completely reproduce the base screen after a predetermined number of reuses of the gravure from.

In another embodiment of the inventive method the filling step and the erasing step include filling and erasing using either a cationically or radically solidifying UV printing ink.

Another aspect of the invention resides in a device for gravure printing which carries out the inventive process. This device includes an erasable and reusable rotating blank gravure form having a basic screen designed for at least a maximum quantity of ink to be transferred. Application means are provided for emitting UV printing ink to completely fill the basic screen. At least one UV dryer overlaps the printing form with and is pivotable toward and away from the gravure form for solidifying the ink. Pixel transfer means ablate the ink in accordance with an image on the surface of the gravure form. An inking system emits UV printing ink for inking the gravure form.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
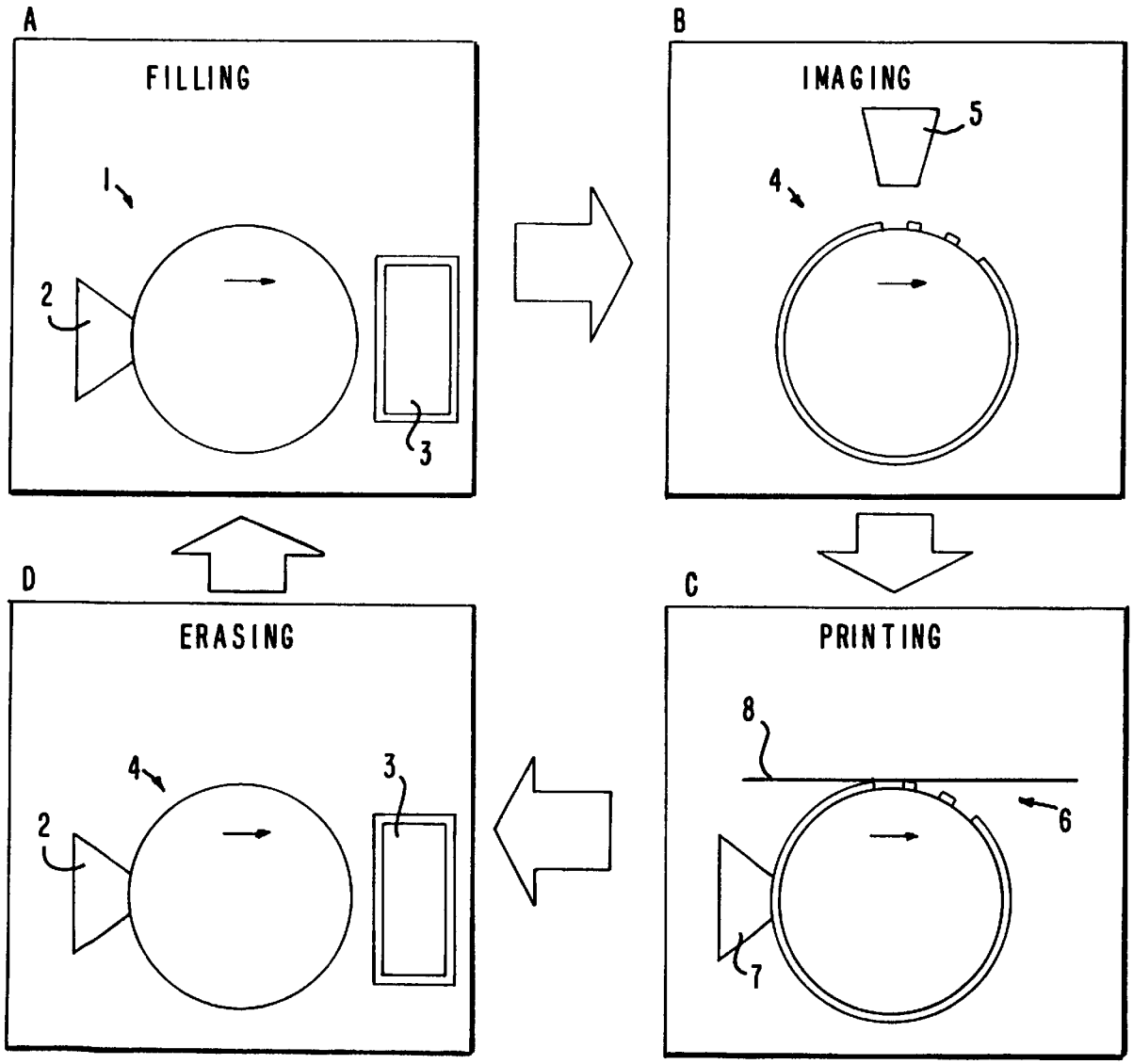
FIG. 1 shows the basic sequence of process steps according to the invention.

As FIG. 1 shows, the process according to the invention has four process steps:

Filling a blank gravure form 1 with filler (A).

The depressions in the basic screen of the blank gravure form 1 are evenly filled with a UV printing ink by an application device 2 in the form of a chamber doctor blade. A UV drier 3, which is positioned directly over the blank form 1, is activated. The printing ink supplied by means of the chamber doctor blade 2 is solidified in the depressions. The slight shrinkage that occurs during solidification of the ink is compensated for by repeated rotations during the filling process; i.e., as precise a filling as desired can be produced by means of successive fillings. In practice, 1 to 10, preferably 3 to 8, rotations of the blank gravure form 1 per filling process result in an optimal filling.

Imaging the filled blank gravure form 4 by thermal ablation of the filler (B).

The supply of printing ink from filling step (a) is shut down. The chamber blade 2 is moved away, and the imaging step begins. Imaging is carried out by means of thermal ablation with a pixel transfer device 5 using a laser. Preferably, a YAG laser is used, which, due to its emitted wave length of 1.064 $\mu$m, is absorbed well by the pigment soot of the black UV printing ink. Alteratively, IR diode lasers with a comparable effect can be used. When such diode lasers are used, "black" printing ink is preferably used as the filler. When using lasers whose absorption process is determined less by the pigment type of the printing ink and more by its binder agent, colored printing inks can also be used for filling. For example, the emitted light of a $CO_2$ laser with a wavelength of approximately 10.6 $\mu$m is advantageously absorbed by many organic binders.

Printing (C)

The gravure form 6 screened in accordance with the image is inked with UV printing ink by means of an inking system 7 in the form of a chamber doctor blade, making it possible to print on the printing web 8.

Preferably, the printing process used is indirect gravure printing, which permits an expanded spectrum of printing stock. An intermediate carrier has a positive effect on ink guidance and ink flow during the use of UV printing inks. In principle, of course, direct gravure printing is also possible with this process.

Erasure of Gravure Form 6 (D)

The gravure form 6 is erased in the process according to the invention primarily by the refilling of the ablated image locations. Nonetheless, different variants can be used for implementation.

The simplest case, using "black" printing ink (or, when a laser-sensitive binder material is used, using "colored" printing ink), can be described as follows: The erasure step (D) is identical to the filling step (A). In other words, after the printing step (C), and after suspension of the renewed, usually lower speed, filling (A), the UV drier 3 is activated. The liquid ink, which is absorbed at the image locations, solidifies. As a result, the blank gravure form 1 is again filled evenly with a solidified UV printing ink. In this variant, the number of cylinder rotations for the filling step (A) is preferably identical to the number for the erasure step (D).

When "black" printing ink is used as the filler and "colored" printing ink is used as the printing ink, erasure by refilling must be preceded by a cleaning of the blank gravure form 6.

Cleaning the printing form is not required to achieve good binding of the old and new fillings (using the same type of binder results in good binding). Rather, cleaning is necessary to avoid changing the sensitivity of the filler substance at the contact points. In the presence of color pigments, the absorber density (pigment soot) is reduced. The result is reduced sensitivity, which can lead to ink density errors in printing during the subsequent printing run.

The cleaning process can be embodied simply: After the chamber doctor blade 7 with colored printing ink is moved out of position, and a large part of the printing ink remaining in the depressions has been extracted by the printing process via the web (paper) 8, the chamber blade 2 for the filler (with the same structure as the chamber blade 7) is moved into position. After several rotations of the gravure form 6 under the activated filler chamber blade 2—but with the UV drier 3 moved out of position—the residual colored printing ink is rinsed out of the depressions in the gravure printing form 6. The impurity of the filler in the chamber blade 2 with colored printing ink lies in the pro mille range and is thus insignificant.

The stability of the renewed filling is comparable to that of the prior filling. Nonetheless, the accumulation of foreign matter in the filler due to impurities (from the ambient air and from paper dust in the printing process, etc.) cannot be ruled out. This circumstance can be dealt with as follows: After a set number of reuses, the filler is completely removed from the depressions in the blank gravure form 1 by means of "laser erasure" (i.e., the laser ablates the filler completely from the depressions in the blank gravure form 1 and inscribes a full-tone image).

Figure 2:
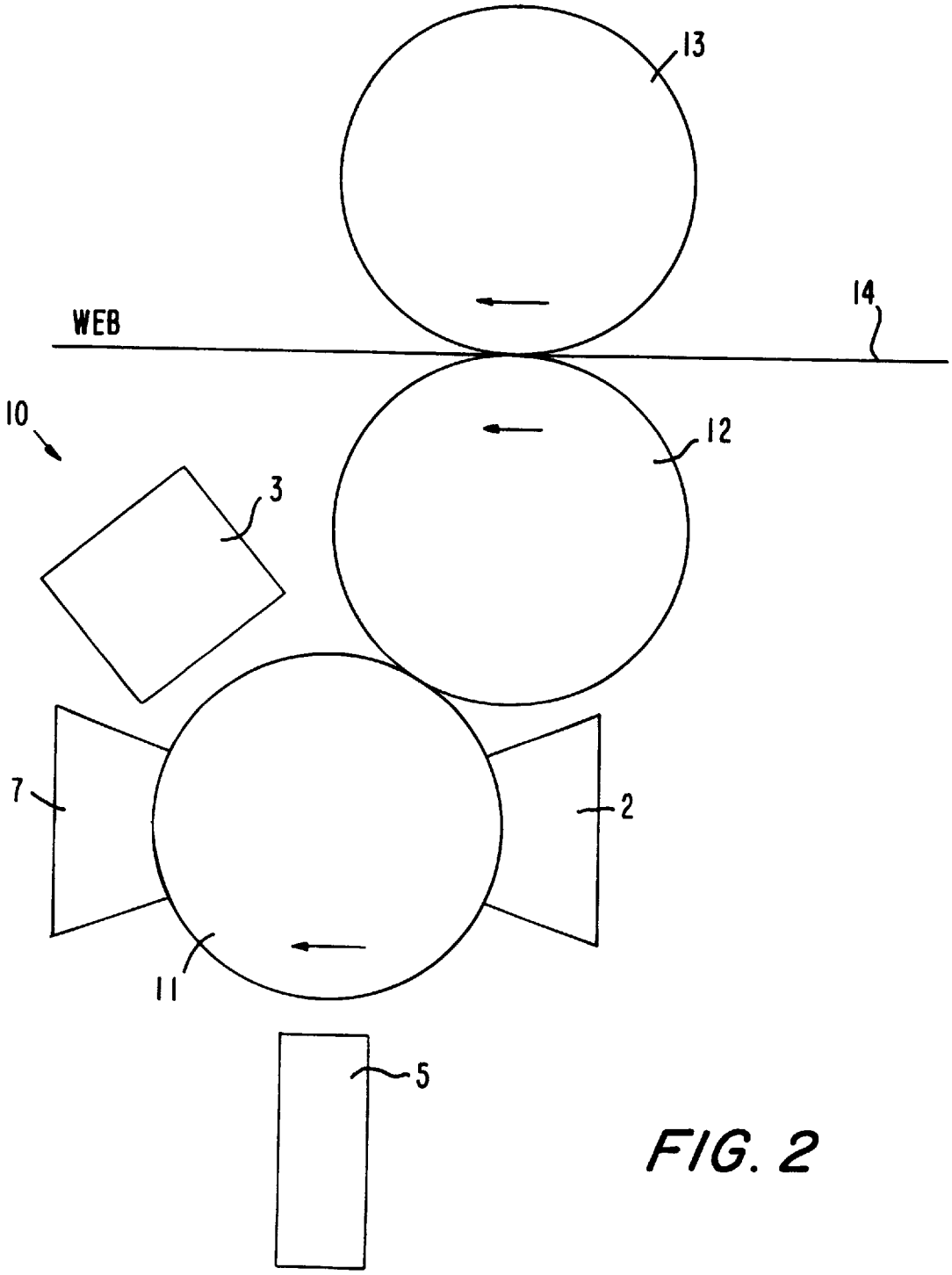
FIG. 2 is a highly schematic drawing of the basic structure of a device to implement the process according to the invention in a gravure printing unit.

FIG. 2 shows a printing group 10 for indirect gravure printing with an ink transfer cylinder 12 and a counterpressure cylinder 13. Between these cylinders runs the printing web 14. An application device 2, in the form of a chamber doctor blade that emits UV printing ink and can completely fill a basic screen of a blank form, is positioned on a gravure printing cylinder 11 in the direction of rotation. For the purpose of ablation in accordance with the image, a pixel transfer device 5 in the form of a laser, particularly a high-power laser, which can be part of an exposure unit traversing the blank gravure form but can also be a semiconductor laser arrangement of several semiconductor lasers, is positioned on the surface of the gravure printing cylinder 11. On the side of the gravure printing cylinder 11, located across from the application device 2 for the filler, there is a UV printing ink inking system, also in the form of a chamber blade. The chamber blade 2 for the filler and the chamber blade 7 for the ink are preferably embodied identically and are located on the circumference of the gravure printing cylinder 11 in such a way as to be movable into and out of position adjacent the cylinder. Furthermore, at least one UV drier 3 that overlaps the breadth of the printing form and can be pivoted to and fro is provided on the gravure printing cylinder 11. Appropriate positioning of a pivotable UV drier—in the present case, behind the inking system 7 in the rotational direction of the gravure printing cylinder 11—makes it possible to use only a single UV drier for the filling step and the printing step.

In special cases, the application device 2 and the inking system 7, instead of being two identical chamber doctor blades, can be embodied as a common aggregate in the form of a chamber doctor blade, so that the filling and inking steps can be implemented with a single chamber doctor blade.

Figure 3:
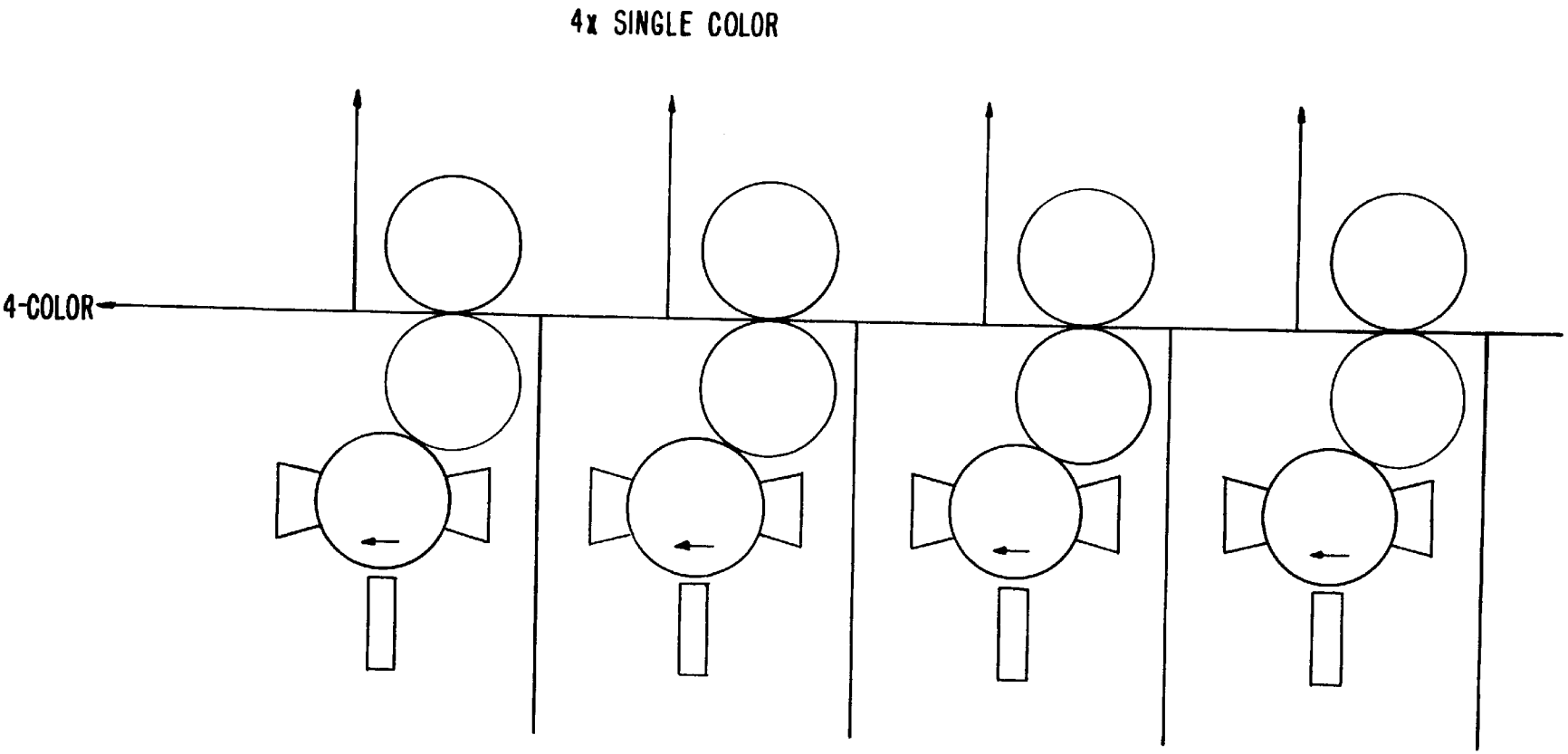
FIG. 3 shows a printing variant using the process according to the invention.

The permanent presence of two UV printing inks in the printing unit ("black" and "colored" printing ink) permits rapid automatic changeover from color printing to black and white printing and vice versa. For example, according to FIG. 3, appropriate printing stock guidance allows a four-color printing machine to be converted into four single-color printing machines.

A ceramic screen roller with a high line count is advantageously used as the blank gravure form. Ceramic material exhibits better wetting behavior than chrome. The high line count improves the ink transfer qualitatively and quantitatively.

Commercially available radiators with Hg steam tubes can be used as UV driers. Ozone-reduced or ozone-free types of radiators are preferred.

UV printing inks are distinguished by their high reaction speed in solidification. According to the prior art, solidification time is in the ms range. During solidification, a highly interconnected and thus difficult-to-dissolve and non-meltable substance is created. In principle, any UV solidifiable, solvent-free liquid ink can be used as the UV printing ink. The cationically interconnected ink types are especially suitable.

The invention is not limited by the embodiments described above which are presented as examples only but can be modified in various ways within the scope of protection defined by the appended patent claims.

We claim:

1. A process for gravure printing with an erasable and reusable gravure form, starting with a blank gravure form with a basic screen designed for at least a maximum quantity of ink to be transferred, the process comprising the steps of:

filling depressions of the basic screen of the blank gravure form evenly with an ultra-violet solidifiable printing ink using an application device; solidifying the evenly applied ultra-violet solidifiable printing ink with a drier that is positionable over the blank gravure form; imaging the form by removing solidified printing ink from the depressions by means of thermal ablation with a pixel transfer device; inking the gravure form screened in accordance with the image with ultra-violet solidifiable printing ink by means of an inking system; printing on a web; and erasing the gravure form for reuse bv refilling ablated image locations with ultra-violet solidifiable printing ink.

2. A process as defined in claim 1, wherein the printing step includes indirect gravure printing.

3. A process as defined in claim 1, wherein the erasing step includes evenly filling the gravure form with liquid ultra-violet solidifiable ink and solidifying the liquid UV ink with a ultra-violet drier.

4. A process as defined in claim 1, and further comprising the step of completely removing the filling from the depressions to completely reproduce the basic screen after a determinable number of reuses of the gravure form.

5. A process as defined in claim 1, wherein the filling step and the erasing step include filling and erasing using one of a cationically solidifying ultra-violet solidifiable printing ink and a radically solidifying ultra-violet solidifiable printing ink.

6. A device for gravure printing, comprising:

an erasable and reusable rotating blank gravure form having a basic screen designed for at least a maximum quantity of ink to be transferred; application means for emitting ultra-violet solidifiable printing ink to completely fill the basic screen; at least one ultra-violet drier that overlaps the printing form width and is pivotable toward and away from the gravure form for solidifying the ink; pixel transfer means for ablating the ink in accordance with an image on a surface of the gravure form; and, an inking system configured to emit ultra-violet solidifiable printing ink for inking the gravure form.

7. A device as defined in claim 6, wherein the blank gravure form is a ceramic screen roller with a high line count.

8. A device as defined in claim 6, wherein the pixel transfer means includes a traversing exposure unit configured as a laser.

9. A device as defined in claim 8, wherein the laser is a semiconductor laser arrangement of multiple semiconductor lasers.

10. A device as defined in claim 8, wherein the laser is a high-power laser.

11. A device as defined in claim 6, wherein the application means and the inking system are comprised of structurally identical chamber doctor blades.

12. A device as defined in claim 11, wherein the application means and the inking system are jointly configured as a single chamber doctor blade.

13. A process for gravure printing with an erasable and reusable gravure form, starting with a blank gravure form with a basic screen designed for at least a maximum quantity of ink to be transferred, the process comprising the steps of:

filling depressions of the basic screen of the blank gravure form evenly with an ultra-violet solidifiable printing ink using an application device; solidifying the evenly applied ultra-violet solidifiable printing ink with a drier that is positionable over the blank gravure form; imaging the form by removing solidified printing ink from the depressions by means of thermal ablation with a pixel transfer device; inking the gravure form screened in accordance with the image with an ultra-violet solidifiable printing ink by means of an inking system; printing on a web; and erasing the gravure form for reuse, the erasing step including evenly filling the gravure form with liquid ultra-violet solidifiable ink and solidifying the liquid ultra-violet ink with a ultra-violet dryer, the erasing step further including cleaning the gravure form by rinsing residual liquid ink from the printing form with liquid ultra-violet solidifiable printing ink using the application device provided for the filling step, and then evenly filling the gravure form with ultra-violet solidifiable ink and solidifying the applied ultra-violet solidifiable printing ink with the ultra-violet dryer.

* * * * *